US006810390B1

(12) United States Patent
Picoult et al.

(10) Patent No.: US 6,810,390 B1
(45) Date of Patent: Oct. 26, 2004

(54) SYSTEM AND METHOD FOR VERIFYING DIGITAL POSTAL MARKS

(76) Inventors: Cheryl L. Picoult, 16 Marsh Pond La., Monroe, CT (US) 06468; Leon A. Pintsov, 10 Governors Row, West Hartford, CT (US) 06117; Nathan Rosenberg, 249 Argyle Rd., Orange, CT (US) 06477; Frederick W. Ryan, Jr., 4 Naples La., Oxford, CT (US) 06478

( * ) Notice: Subject to any disclaimer, the term of this patent is extended or adjusted under 35 U.S.C. 154(b) by 978 days.

(21) Appl. No.: 09/649,470

(22) Filed: Aug. 28, 2000

(51) Int. Cl.[7] ..... G07B 17/60

(52) U.S. Cl. ..... 705/62; 705/60; 705/61; 705/401; 705/404; 705/406; 705/410

(58) Field of Search ..... 705/60, 61, 62, 705/401, 404, 406, 410; 700/108, 109, 110

(56) References Cited

U.S. PATENT DOCUMENTS

| | | | | |
|---|---|---|---|---|
| 4,743,747 A | | 5/1988 | Fougere | 235/494 |
| 4,965,829 A | | 10/1990 | Lemelson | |
| 5,748,780 A | | 5/1998 | Stolfo | 382/232 |
| 6,049,775 A | | 4/2000 | Gertner | 705/8 |
| 6,064,995 A | | 5/2000 | Sansone | 705/410 |
| 6,119,051 A | | 9/2000 | Anderson | 700/221 |
| 6,398,106 B1 | * | 6/2002 | Ulvr et al. | 235/375 |

FOREIGN PATENT DOCUMENTS

US WO 02/25597 A1 * 9/2001 ..... G07B/17/00

OTHER PUBLICATIONS

Cullen, M; Pinstov, I. ; Romansky, B., Reading encrypted postal indicia, Institution of Electrical Engineers, IEEE Computer Society Press, 1995, Part vol. 2, p. 1018–23 vol. 2.*

* cited by examiner

*Primary Examiner*—James P. Trammell
*Assistant Examiner*—Daniel L Greene
(74) *Attorney, Agent, or Firm*—Charles R. Malandra, Jr.; Angelo N. Chaclas

(57) ABSTRACT

A system and corresponding method for verifying digital postal marks on mailpieces or, more generally, for verifying a mark on any kind of document where the mark represents value and might be counterfeited or used fraudulently, the system including in the specific case of verifying a digital postal mark: a plurality of mail processing machine verification modules (MPMVMs), each responsive to information obtained from sampled mailpieces, and each further responsive to a control file specifying patterns of sampling and specifying responses to sampling results, each MPMVM performing local verification of the sampled mailpieces according to the control file, each MPMVM for providing the information obtained from the sampled mailpieces and optionally the local verification results; and a data center verification module (DCVM), responsive to the information obtained from the sampled mailpieces and also to the local verification results, for analyzing the information obtained from the sampled mailpieces, for periodically providing a control file in replacement of any existing control file, the replacement control file being based on the results of collectively analyzing the information obtained from the mailpieces. In some applications, the control file includes a suspect list and a configuration file, the suspect list providing a list of postage meter identifiers and, for each postage meter identifier, a corresponding action each MPMVM is to take when processing a mailpiece with an indicium imprinted by said postage meter, the configuration file providing sampling criteria and tests to be performed by each MPMVM.

19 Claims, 3 Drawing Sheets

SYSTEM AND METHOD FOR VERIFYING DIGITAL POSTAL MARKS

TECHNICAL FIELD

The present invention pertains to the field of detecting fraud in providing postage for mailpieces, and more particularly to dynamically adapting strategies for detecting such fraud. More generally, the present invention pertains to detecting fraud in connection with any kind of a value-bearing mark or marks on a document (such as a coupon or ticket), not necessarily a postal mark.

BACKGROUND OF THE INVENTION

The prior art teaches systems for verifying digital postal marks on mailpieces (the marks imprinted by postal machines or postal security devices, called here indicia) to guard against different kinds of attempts at counterfeiting the postal marks, such as duplicating a postal mark, or otherwise using an invalid postal mark, such as for example using a postal mark imprinted by a stolen postal meter. Some of the systems taught by the prior art are manual, requiring the use of handheld scanners. The scanners scan indicia imprinted on mailpieces, including the digital postal marks, and the system then validates the indicia in situ, with no data sent to a central facility where the data could be examined by comparing it with data from other verification systems.

The prior art also teaches automatically reading, at various branch facilities, inspection cards (but not envelopes) that are all identical in size and format, and transferring the data from the inspection cards to a data center for batch analysis. The data center, however, does not influence the testing pattern of the branch facilities based on the batch analysis. Nor does the data center perform any tests beyond cryptographic validation.

What is needed is a system including various branch or local facilities in which each branch facility automatically reads mailpieces of various sizes and formats, and provides the information determined from reading the mailpieces to a central facility where the mailpiece information can be examined in the aggregate, including comparing mailpiece information with historical data, and where the testing and sampling done on the physical mailpiece at the branch facilities is tailored based on the results of the aggregate examinations performed at the central facility. Such a system could vary its behavior to respond to observed changes in the likelihood of different kinds of attempts at passing counterfeit digital postal marks.

SUMMARY OF THE INVENTION

Accordingly, the present invention provides, a system and corresponding method for verifying digital postal marks on mailpieces or, more generally, for verifying a mark on any kind of document when the mark represents value and might be counterfeited or used fraudulently, the system including in the specific case of verifying digital postal marks: a plurality of mail processing machine verification modules (MPMVMs) at field locations, each responsive to information obtained from sampled mailpieces, and each further responsive to a control file specifying patterns of sampling and specifying responses to sampling results, each MPMVM performing local verification of the sampled mailpieces according to the control file, each MPMVM for providing the information obtained from the sampled mailpieces and optionally the local verification results; and a data center verification module (DCVM) at a central location, responsive to the information obtained from the sampled mailpieces and also to the local verification results, for analyzing the information obtained from the sampled mailpieces, for periodically providing a control file in replacement of any existing control file, the replacement control file being based on the results of collectively analyzing the information obtained from the mailpieces.

In a further aspect of the invention, the control file includes a suspect list and a configuration file, the suspect list providing a list of postage meter identifiers and, for each postage meter identifier, a corresponding action each MPMVM is to take when processing a mailpiece with an indicium imprinted by said postage meter, the configuration file providing sampling criteria and tests to be performed by each MPMVM. In some applications, the action to be taken is selected from the group consisting of outsorting the mailpiece, advancing the mailpiece, and transferring to the DCVM at least some of the information obtained from the mailpiece. Also in some applications, the configuration file allows for different suites of tests to be performed for different mailpieces.

In a still further aspect of the invention, the control file provided to one of the MPMVMs is tailored to the MPMVM independent of the control file provided to another of the MPMVMs, thereby tailoring the local verification process for each MPMVM.

In another further aspect of the invention, the DCVM includes: a user interface that enables a user to specify via the control files the action to be take by each of the MPMVMs in response to particular sampled data; a mail inspection analysis tool, for analyzing historical mail data either automatically or manually, and for providing reports based on the historical analysis and control files for MPMVMs; a mailpiece data testing module, for collectively testing mailpiece data provided by the MPMVMs; a verification database, for storing mailpiece data and results of the tests performed by the mailpiece data testing module; and a key management system, for managing keys used in performing the cryptographic authentication.

In still another, further aspect of the invention, the MPMVM includes: a controller, responsive to the control file, for providing tests of mailpiece information and a testing sequence according to the control file, and further for providing suspect data indicated by the control file, and further responsive to results of the tests, for providing local verification results based on interpreting the results of the tests using suspect data, for providing a mailpiece processing command based on interpreting the results of the tests, the mailpiece processing command being selected from the group consisting of outsort the mailpiece, advance the mailpiece, and transfer to the DCVM information obtained from the mailpiece, and for providing the mailpiece information; a suspect database, for storing and making accessible suspect data; and a mailpiece test engine, responsive to scanned mailpiece information, for performing mailpiece data tests on the scanned mailpiece information according to the tests of mailpiece information and the testing sequence, for providing the mailpiece data test results including the mailpiece information.

BRIEF DESCRIPTION OF THE DRAWINGS

The above and other objects, features and advantages of the invention will become apparent from a consideration of the subsequent detailed description presented in connection with accompanying drawings, in which.

DETAILED DESCRIPTION

Figure 1:
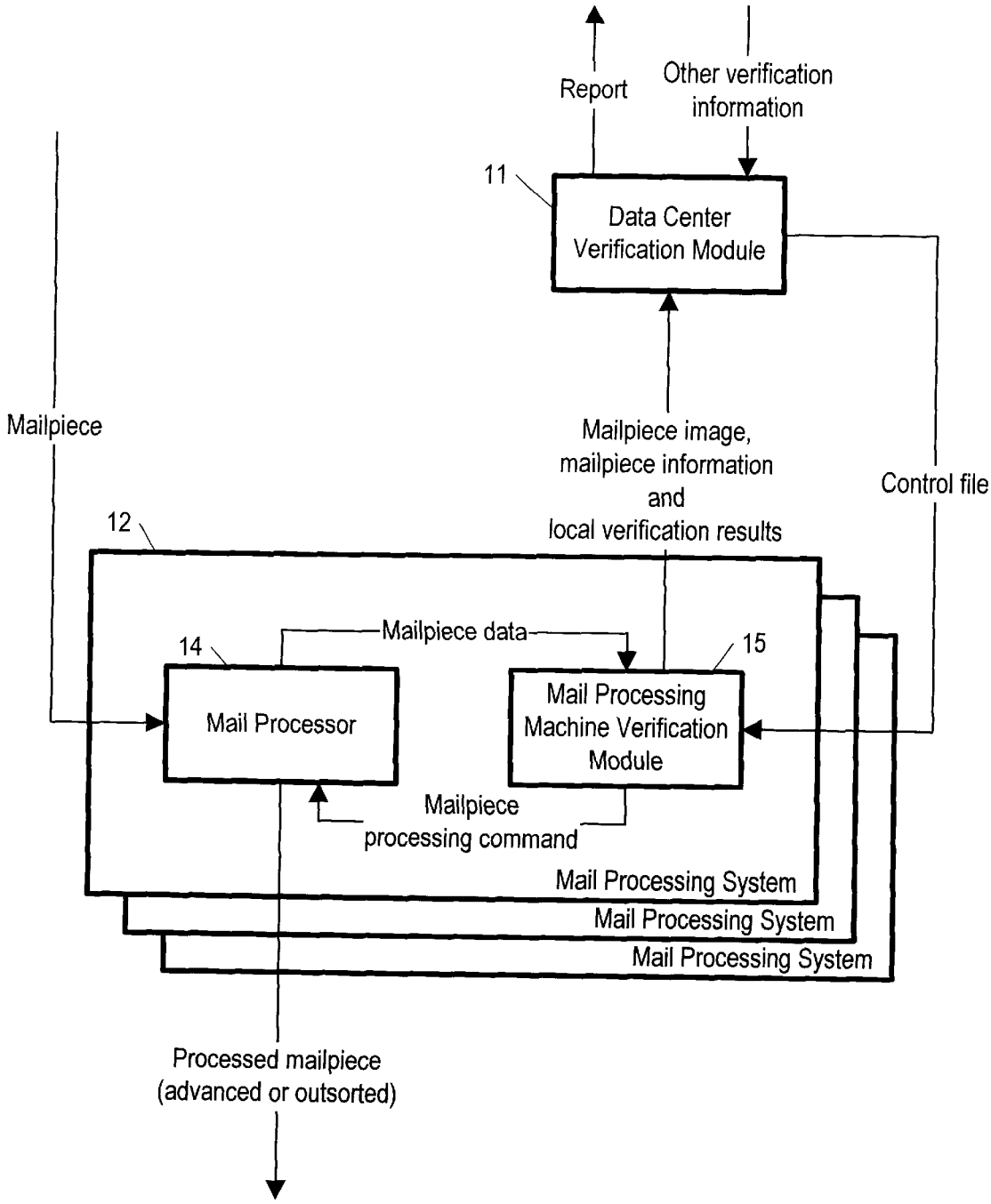
FIG. 1 is a block diagram/data flow diagram of a system for which the method of the present invention is intended, including a data center verification module and several mail processing systems, each including a mail processing matching verification module.

Referring now to FIG. 1, a system for verifying digital postal marks is shown as including a data center verification module (DCVM) 11 at a central location and, each at a different field location, a plurality of mail processing systems 12, each mail processing system including a mail processing machine verification module (MPMVM) 15 and a mail processor 14. The mail processing systems examine successive mailpieces and provide to the DCVM 11 mailpiece data, which may include the mailpiece image, and mailpiece information imprinted on the mailpiece (mailpiece information), and the results of local (in situ) verification testing by the mail processing system. The local verification results are also provided to the DCVM 11. The DCVM 11 in turn provides a control file to each mail processing system 12, and more specifically, to the MPMVM 15 of each mail processing system for each successive mailpiece. The control file guides the tests used by each mail processing system in performing local verification.

Whether images of each mailpiece are sent to the DCVM is controlled by how the system is configured. The ability to configure what information is sent to the DCVM is a particularly advantageous feature of the present invention.

The local verification testing by the MPMVM 15 is performed for a mailpiece arriving at the mail processor 14 based on the mailpiece information provided by the mail processor 14. As a result of local verification testing, the MPMVM 15 issues to the mail processor 14 a mailpiece processing command, which indicates to the mail processor how to dispose of the mailpiece. The mailpiece can either be advanced, i.e., no particular action is taken, or outsorted, if the mailpiece fails the local verification testing. Other possible commands are described below.

Figure 2:
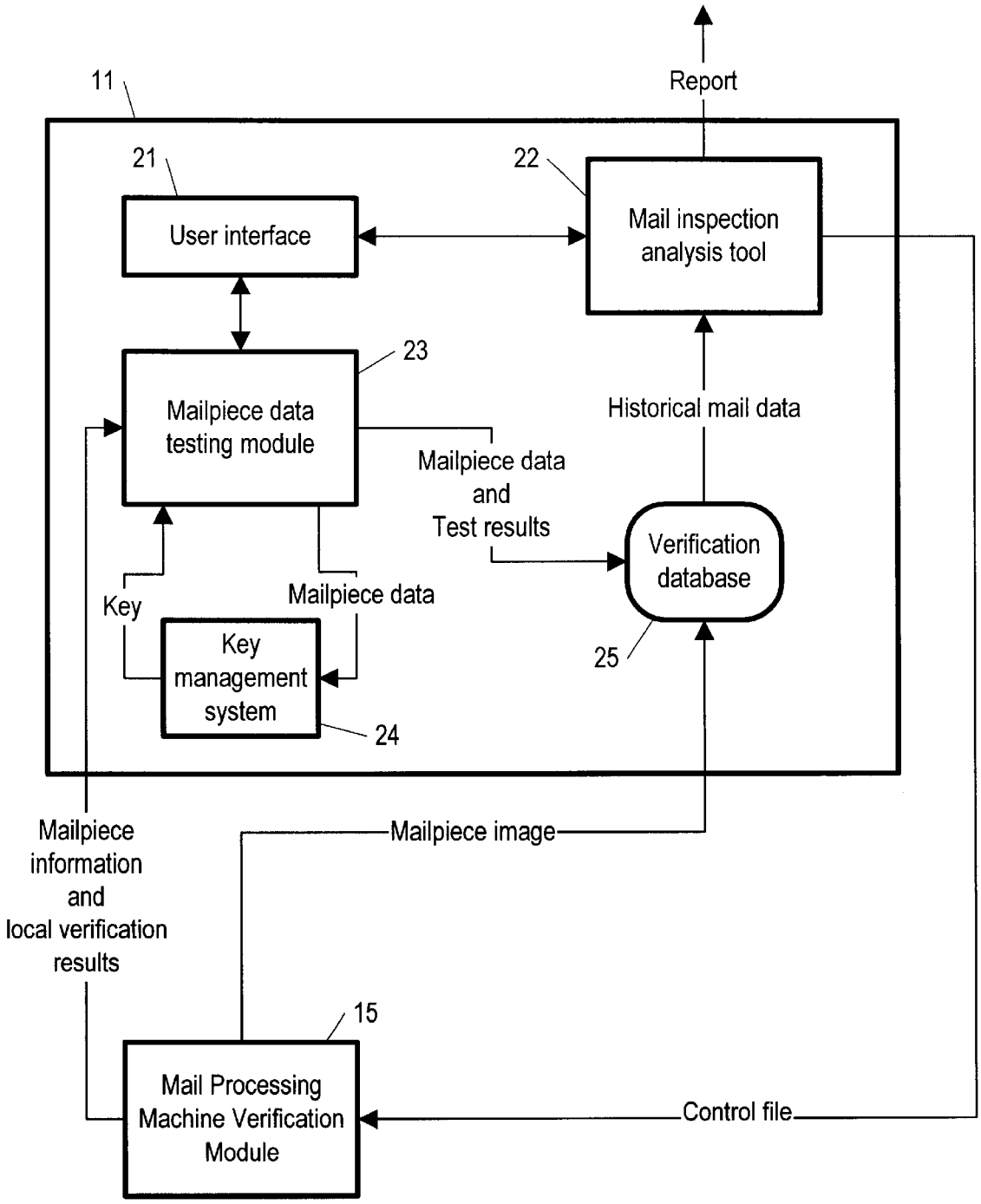
FIG. 2 is a block diagram/data flow diagram showing the data center verification module in more detail.

Referring now to FIG. 2, the DCVM 11 is shown in more detail as including a user interface 21 that allows a user to interact with a mail inspection analysis tool 22 and a mailpiece data testing module 23. The DCVM 11 also includes a verification database 25 that holds mailpiece images received from the MPMVM 15 as well as mailpiece data and test results provided by the mailpiece data testing module 23. The mailpiece data testing module 23 receives the mailpiece information and local verification results provided by the MPMVM 15. It then tests the indicia imprinted on the mailpiece for authenticity using keys provided by a key management system 24 in response to the mailpiece data. Finally, it provides the mailpiece data and test results to the verification database 25. The mail inspection analysis tool 22 examines historical mail data stored in the verification database 25 as a basis for providing a control file in replacement of any existing control file in use by an MPMVM 15. The mail inspection analysis tool 22 provides the control file to the MPMVM 15 at each mail processing system 12.

Figure 3:
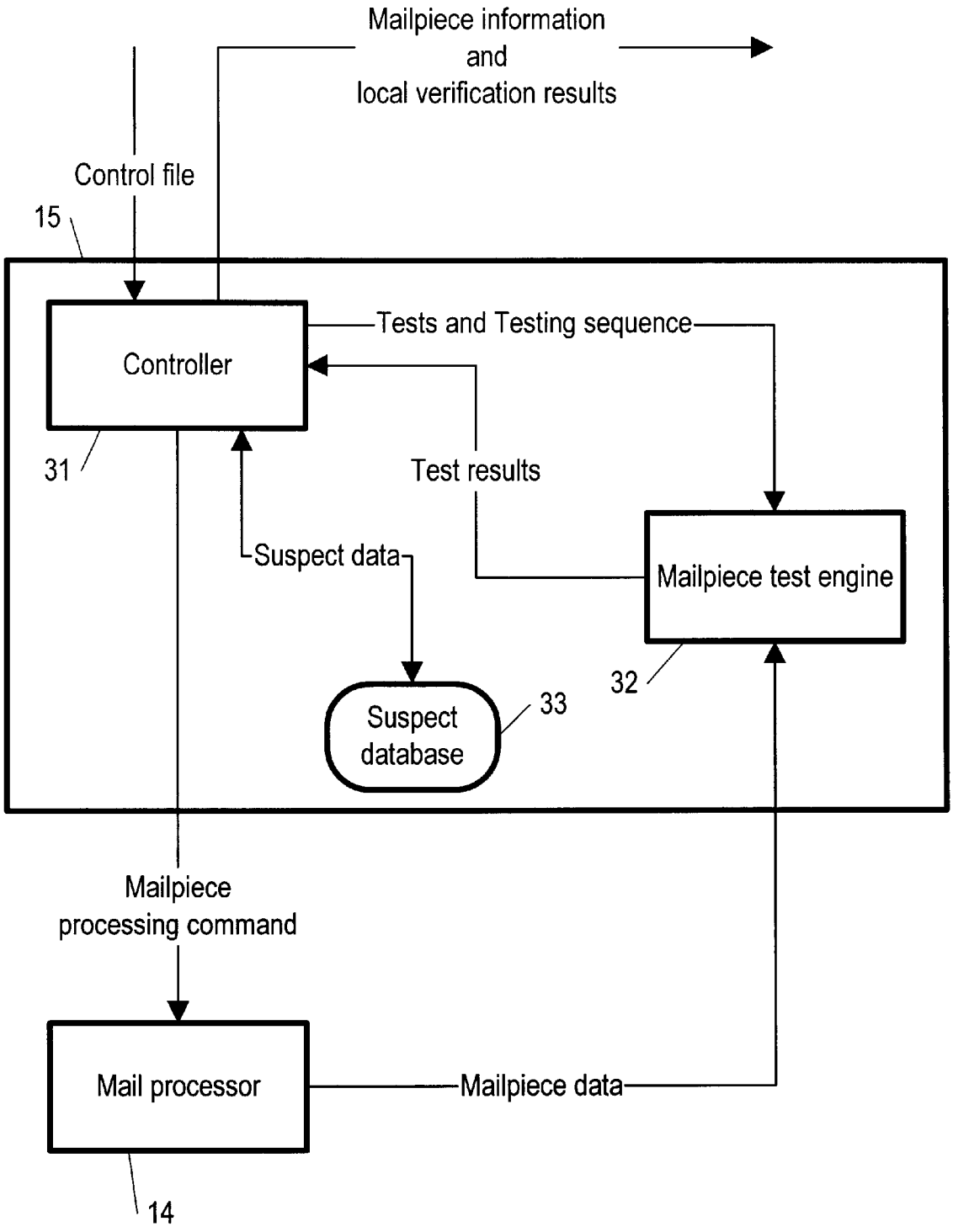
FIG. 3 is a block diagram/data flow diagram showing the mail processing machine verification module in more detail.

Referring now to FIG. 3, the MPMVM 15 is shown in more detail as including a controller 31 that receives the control file from the DCVM 11 and provides suspect data to a suspect database 33, the suspect data indicating meter identifiers for meters reported lost or stolen or for meters indicated on digital postal marks determined to be invalid for other reasons. The controller 31 derives the suspect data from the control file. The controller 31 also derives from the control file the tests and testing sequence that are to be performed to provide local verification. The tests and testing sequence are provided to a mailpiece test engine 32, which receives the mailpiece information from the MPMVM 15 and provides test results for the local verification of the associated mailpiece. The tests and testing sequence account for suspect data stored in the suspect database 33. The controller 31 interprets the test results to determined the (final) local verification test results and, on the basis of the local verification test results, provides the mailpiece processing command to the mail processor 14, indicating whether the mailpiece is to be advanced (no action taken) or outsorted. (The mailpiece processing command can also indicate other actions to be taken by the mail processor, as explained below.) The control file conveys one or another or both of two kinds of data: suspect data and configuration data. Suspect data is data for a suspect meter (or equivalently a postal security device), and includes the meter identifier along with an appropriate action that the mail processing machine is to take upon encountering a mailpiece with the specified meter (or equivalently a postal security device). The alternative actions that can be taken upon encountering a suspect meter (or postal security device) include: continuing to collect data and otherwise taking no action; holding the mailpiece in a holding bin (i.e. outsorting the mailpiece); sending the mailpiece information to the DCVM 11, sending an electronic image of the mailpiece to the DCVM 11, or taking no action at all, i.e. simply advancing the mailpiece.

Configuration data specifies the suite of tests that are to be performed for each sampled mailpiece, along with test sequences and, in addition, the data that is to be reported back to the DCVM (e.g. whether individual test results are to be reported back to the DCVM or only a pass/fail indication, or whether images are to be reported back to the DCVM for every mailpiece, only for those that fail, or for some sample). Configuration data can also specify sampling criteria and can specify that a different suite of tests is to be performed for different mailpieces. For example, the configuration file could specify that every third mailpiece is to be sampled (tested), and that every first mailpiece so sampled is to be tested according to one suite of tests, and every second mailpiece so sampled is to be tested according to another suite of tests. As another example, the configuration file could specify that different suites of tests are to be performed for different kinds of mailpiece (e.g. closed information-based indicia mail, open information-based indicia mail, or traditional metered or permit mail.) In addition, the DCVM can send different control files to different mail processing systems 12, allowing the local verification process to be tailored by site location, date, time of day, or other factors.

Discussion of Use of the Control File

The verification system of the present invention uses the control file to guard against various kinds of fraud in using a digital postal mark. For example, a perpetrator may attempt to counterfeit a digital postal mark by guessing at a token or a digital signature. To guard against such a threat, the system uses cryptographic analysis, which requires having access to keys needed to verify the digital signature. If a mail processing machine discovers such a counterfeit digital postal mark, the control file provided by the DCVM 11 could direct the mail processing system 12 to outsort the mailpiece, save its image, transfer the data to the data center, and generate and print an identification tag for the mailpiece. Later, at the DCVM 11, the meter identifier of the meter associated with the unsuccessful counterfeited digital postal mark could be added to the suspect data stored in the verification database 25.

As another example, in the case of a lost or stolen meter, it would be necessary that the customer report that the meter is lost or stolen. (FIG. 1 shows a dataflow identified as "other verification data" that includes as one possibility a report of a lost or stolen meter.) Then the DCVM 11 would add the meter identifier to the suspect data stored in the verification database 25 and would include the suspect data in a later control file. In case a mail processing system 12 encounters a digital postal mark created by a lost or stolen meter that has been reported lost or stolen, (and the verification database has been correspondingly updated), the control file would have communicated the meter identifier as suspect data, which would have been added to the suspect database 33 in some or all of the mail processing systems. Thus, the mail processing machine would know that the mailpiece is fraudulent, and would likely have directions via control files to outsort the mailpiece, save its image, transfer the mailpiece data to the data center, and generate and print an identifier tag.

As another example, in case of an attempt at using a digital postal mark that is a duplicate of an authentic digital postal mark, it is necessary to have access to the authentic digital postal mark. Duplicate testing is done, in the preferred embodiment, only at the DCVM 11. If a duplicate digital postal mark is detected by the DCVM 11, it would add the meter identifier of the duplicate digital postal mark to the verification database 25 as suspect data.

In some applications, the verification system of the present invention would be operated by an entity that is not itself the post office. In such an arrangement, it is advantageous to access information in databases of the post office relevant to verifying digital postal marks, such as whether inconsistent financial or historical incidents involving a meter (or postal security device) had been reported, and to then update the verification data base with such information. (The dataflow identified as "other verification data" in FIG. 1 is intended to encompass such information at the post office. Other information that is of interest in the databases of the U.S. Post Office includes the identifiers of meters that have been reported lost or stolen, and the identifiers of meters recently brought on line. In case of such an arrangement, the DCVM 11 would provide periodic reports to the post office, reports indicating for example that fraud has been detected in connection with a digital postal mark. The dataflow identified as "report" in FIG. 1 is intended to encompass such reports.

In some applications, it may be the case that the data required to perform local verification cannot be extracted from an envelope by a single mail processor 14. For example, if a human readable information and bar coded digital postal mark information are both required for a particular test but cannot be extracted by a single mail processor 14, then two different mail processors 14 would be needed by the mail processing system 12. In such an application, according to the invention, the MPMVM 15 would manage the data extracted from the same mailpiece by the two different mail processors, and would synchronize the sampling by the two different mail processors.

Ordinarily, the mail processing system 12 provides to the data center verification module 11 mailpiece information only when corresponding mailpiece does not verify locally, i.e. does not pass all tests conducted by the MPMVM 15. However, the control file may require that for some of the mailpieces that pass the local verification test, the mailpiece information is to be provided to the DCVM 11. The control file may indicate either randomly sampling (selecting mailpieces at random as those for which the locally verified mailpiece information would be provided to the DCVM 11) or sampled based on some other criteria. Providing mailpiece information and local verification results for a mailpiece to the DCVM 11, even when the mailpiece verifies locally, enables guarding against duplicate digital postal marks.

Scope of the Invention

It is to be understood that the above-described arrangements are only illustrative of the application of the principles of the present invention. In particular, the present invention is of use in processing other forms of mail, such as in processing permit mail, where a predetermined number of mailpieces are allowed for a given permit number. In addition, besides being of use in mail processing, the present invention can also be used in providing verification in connection with other value-oriented services, such as ticket processing, coupon processing, check processing and in general processing any kind of document bearing a mark that represents value and that might be counterfeited or used fraudulently. In such applications, the Mail Processing Machine Verification Modules of the applications for verifying digital postal marks become Document Processing Machine Verification Modules. Numerous further modifications and alternative arrangements may be devised by those skilled in the art without departing from the spirit and scope of the present invention, and the appended claims are intended to cover such modifications and arrangements.

What is claimed is:

1. A system for verifying digital postal marks on mailpieces, the system, comprising:

(a) a plurality of mail processing machine verification modules (MPMVMs), each responsive to information obtained from sampled mailpieces, and each further responsive to a control file specifying patterns of sampling and specifying responses to sampling results, each MPMVM performing local verification of the sampled mailpieces according to the control file, each MPMVM for providing the information obtained from the sampled mailpieces and optionally the local verification results; and (b) a data center verification module (DCVM), responsive to the information obtained from the sampled mailpieces and also to the local verification results, for analyzing the information obtained from the sampled mailpieces, for periodically providing a control file in replacement of any existing control file, the replacement control file being based on the results of collectively analyzing the information obtained from the mailpieces.

2. The system of claim 1, wherein the control file includes a suspect list and a configuration file, the suspect list providing a list of postage meter identifiers and, for each postage meter identifier, a corresponding action each MPMVM is to take when processing a mailpiece with an indicium imprinted by the postage meter having said postage meter identifier, the configuration file providing sampling criteria and tests to be performed by each MPMVM.

3. The system of claim 2, wherein the control file provided to one of the MPMVMs is tailored to the MPMVM independently of the control file provided to another of the MPMVMs.

4. The system of claim 2, wherein the action to be taken is selected from the group consisting of outsorting the mailpiece, advancing the mailpiece, and transferring to the DCVM at least some of the information obtained from the mailpiece.

5. The system of claim 1, wherein the DCVM comprises:

(a) a user interface that enables a-user to specify via the control files the action to be take by each of the MPMVMs in response to particular sampled data;

(b) a mail inspection analysis tool, for analyzing historical mail data either automatically or manually, and for providing reports based on the historical analysis and control files for MPMVMs;

(c) a mailpiece data testing module, for collectively testing mailpiece data provided by the MPMVMs;

(d) a verification database, for storing mailpiece data and results of the tests performed by the mailpiece data testing module; and (e) a key management system, for managing keys used in performing the cryptographic authentication.

6. The system of claim 1, wherein the MPMVM comprises:

(a) a controller, responsive to the control file, for providing tests of mailpiece information and a testing sequence according to the control file, and further for providing suspect data indicated by the control file, and further responsive to results of the tests, for providing local verification results based on interpreting the results of the tests using suspect data, for providing a mailpiece processing command based on interpreting the results of the tests, the mailpiece processing command being selected from the group consisting of outsort the mailpiece, advance the mailpiece, and transfer to the DCVM information obtained from the mailpiece, and for providing the mailpiece information;

(b) a suspect database, for storing and making accessible suspect data; and (c) a mailpiece test engine, responsive to scanned mailpiece information, for performing mailpiece data tests on the scanned mailpiece information according to the tests of mailpiece information and the testing sequence, for providing the mailpiece data test results including the mailpiece information.

7. The system of claim 1, wherein the DCVM performs cryptographic authentication and consistency testing of the information obtained from the sampled mailpieces.

8. The system of claim 2, wherein the configuration file allows for different suites of tests to be performed for different mailpieces.

9. A system for verifying a digital mark on a document, the system comprising:

(a) a plurality of document processing machine verification modules (DPMVMs), each responsive to information obtained from sampled documents, and each further responsive to a control file specifying patterns of sampling and specifying responses to sampling results, each DPMVM performing local verification of the sampled documents according to the control file, each DPMVM for providing the information obtained from the sampled documents and optionally the local verification results; and (b) a data center verification module (DCVM), responsive to the information obtained from the sampled documents and also to the local verification results, for analyzing the information obtained from the sampled documents, for periodically providing a control file in replacement of any existing control file, the replacement control file being based on the results of collectively analyzing the information obtained from the documents.

10. The system of claim 9, wherein the control file includes a suspect list and a configuration file, the suspect list providing a list of meter identifiers of meters used to create the marks and, for each meter identifier, a corresponding action each DPMVM is to take when processing a document with an indicium imprinted by said meter, the configuration file providing sampling criteria and tests to be performed by each DPMVM.

11. The system of claim 10, wherein the control file provided to one of the DPMVMs is tailored to the DPMVM independently of the control file provided to another of the DPMVMs.

12. The system of claim 10, wherein the action to be taken is selected from the group consisting of outsorting the document, advancing the document, and transferring to the DCVM at least some of the information obtained from the document.

13. The system of claim 9, wherein the DCVM comprises:

(a) a user interface that enables a user to specify via the control files the action to be take by each of the DPMVMs in response to particular sampled data;

(b) a document inspection analysis tool, for analyzing historical document data either automatically or manually, and for providing reports based on the historical analysis and control files for DPMVMs;

(c) a document data testing module, for collectively testing document data provided by the DPMVMs;

(d) a verification database, for storing document data and results of the tests performed by the document data testing module; and (e) a key management system, for managing keys used in performing the cryptographic authentication.

14. The system of claim 9, wherein the DPMVM comprises:

(a) a controller, responsive to the control file, for providing tests of document information and a testing sequence according to the control file, and further for providing suspect data indicated by the control file, and further responsive to results of the tests, for providing local verification results based on interpreting the results of the tests using suspect data, for providing a document processing command based on interpreting the results of the tests, the document processing command being selected from the group consisting of outsort the document, advance the document, and transfer to the DCVM information obtained from the document, and for providing the document information;

(b) a suspect database, for storing and making accessible suspect data; and (c) a document test engine, responsive to scanned document information, for performing document data tests on the scanned document information according to the tests of document information and the testing sequence, for providing the document data test results including the document information.

15. The system of claim 9, wherein the DCVM performs cryptographic authentication and consistency testing of the information obtained from the sampled documents.

16. The system of claim 10, wherein the configuration file allows for different suites of tests to be performed for different documents.

17. A method for verifying a mark on a document, the method comprising the steps of:

a) providing from a Data Center Verification Module a control file specifying patterns of sampling documents and specifying responses to sampling results;

b) receiving at a plurality of Mail Processing Machine Verification Modules the control file, performing sampling according to the control file to obtain information on the document, and responding to the results of the sampling according to the control file, wherein the sampling includes performing local verification of the mark on the document according to the control file;

c) providing to the Data Center Verification Module the information obtained from the sampled documents and optionally the local verification results;

d) analyzing at the Data Center Verification Module the information obtained at each Mail Processing Machine Verification Module from the sampled documents, and periodically providing a control file in replacement of any existing control file, the replacement control file being based on the results of the collectively analyzing the information obtained from the sampled documents.

18. The method of claim 17, further comprising the step of having the Data Center Verification Module include in the control file a suspect list and a configuration file, the suspect list providing a list of meter identifiers of meters used to create marks and, for each meter identifier, a corresponding action each Mail Processing Machine Verification Module is to take when processing a document with an indicium imprinted by said meter, the configuration file providing sampling criteria and tests to be performed by each field location.

19. The method of claim 17, wherein the control file provided by the Data Center Verification Module to each Mail Processing Machine Verification Module is tailored to the field location independently of the control file provided to another of the field locations.

* * * * *